United States Patent [19]

Smith et al.

[11] Patent Number: 4,765,956

[45] Date of Patent: Aug. 23, 1988

[54] NICKEL-CHROMIUM ALLOY OF IMPROVED FATIGUE STRENGTH

[75] Inventors: Gaylord D. Smith, Huntington; Jack M. Wheeler, Lesage; Stephen C. Tassen, Huntington, all of W. Va.

[73] Assignee: Inco Alloys International, Inc., Huntington, W. Va.

[21] Appl. No.: 897,746

[22] Filed: Aug. 18, 1986

[51] Int. Cl.[4] ..... C22C 19/05

[52] U.S. Cl. ..... 420/445; 420/446; 420/447; 420/448; 420/452; 420/453; 420/454; 420/584; 420/585; 420/586; 420/588

[58] Field of Search ..... 420/445, 446, 447, 448, 420/588, 452, 453, 454, 584–586; 148/427, 428

[56] References Cited

U.S. PATENT DOCUMENTS

| | | | |
|---|---|---|---|
| 3,046,108 | 7/1962 | Eiselstein | 420/448 |
| 3,160,500 | 12/1964 | Eiselstein et al. | 148/428 |
| 3,843,359 | 10/1974 | Fiene et al. | 420/453 |
| 4,210,447 | 7/1980 | Tsai | 420/443 |

*Primary Examiner*—R. Dean

*Attorney, Agent, or Firm*—Raymond J. Kenny; Francis J. Mulligan

[57] ABSTRACT

Nickel-chromium alloys consisting essentially of from 30–75 nickel, 12–30% chromium, up to 10% molybdenum, up to 8% tungsten, up to 15% cobalt, up to 5% of niobium and/or tantalum, titanium plus aluminum up to 5%, and carbon nitrogen and silicon in correlated percentages to thereby improve low cycle and thermal fatigue strength, the balance being from 0 to 50% iron.

14 Claims, No Drawings

NICKEL-CHROMIUM ALLOY OF IMPROVED FATIGUE STRENGTH

FIELD OF INVENTION

The present invention is directed to nickel-chromium alloys, and more particularly to nickel-chromium alloys of enhanced low cycle and thermal fatigue properties which render them suitable for high temperature applications, such as bellows and recuperators.

INVENTION BACKGROUND

There are a host of diverse applications requiring alloys which manifest a desired combination of properties for use under elevated temperature conditions. And nickel-chromium alloys of various chemistries are conventionally used to meet such requirements. In this connection, there are a number of industrial and/or commercial applications in which a material is subjected to repetitive stress. This focuses attention on the properties of low cycle and thermal fatigue. Low cycle fatigue (LCF) can be considered as a failure mode caused by the effect of an imposed repetition of mechanical stress. Thermal fatigue can be considered a form of low cycle fatigue where the imposed repetitive stress is thermally induced as the result of differential expansion or contraction during a change of temperature in the material.

Bellows and recuperators might be mentioned as examples where LCF plays a significant role. High temperature bellows are used to allow passage of hot process gas between different equipment, vessels or chambers where cyclic or differential temperatures may exist. Bellows often have a corrugated structure to permit easy flexure under conditions of vibration and cyclic temperature which induce thermal contraction and/or expansion. Seeking optimum performance for bellows requires maximizing low cycle and thermal fatigue and also ductility and microstructural stability. In practice the approach has been to improve such characteristics through grain size control (annealing treatments) and maximizing ductility. But this can result in lower fatigue strength.

With regard to recuperators they are waste heat recovery devices designed to improve the thermal efficiency of power generators and industrial heating furnaces. More specifically a recuperator is a direct type of heat exchanger where two fluids are separated by a barrier through which heat flows. Nickel-chromium alloys, inter alia, are a preferred common material of construction because of their high heat conductivity, given that waste heat temperatures do not exceed about 1660° F. (about 870° C.). One of the alloys used for this application is the Ni-Cr-Mo-Cb-Fe alloy described in U.S. Pat. No. 3,160,500 ('500) and generically known commercially as Alloy 625.

Among the causes of failure of a recuperator is low cycle and thermal fatigue, with creep, high temperature gaseous corrosion, and excessive stresses due to thermal expansion differentials being others. A cause of premature failure in respect of the earlier designed recuperators has been attributed to lack of recognition that excessive stresses required allowance for thermal expansion. More recently, failures have involved inadequate resistance to thermal fatigue (and also gaseous corrosion). It is virtually impossible, as a practical matter to eliminate thermal gradients in an alloy. High thermal conductivity will minimize thermal fatigue but will not eliminate existing thermal gradients. It might be added that thermal fatique resistance can also be enhanced by achieving improved stress rupture strength and microstructural stability.

In any case, as will be demonstrated infra nickel-chromium alloys such as described in '500 manifest a propensity to undergo premature fatigue failure in applications of the bellows and recuperator types.

SUMMARY OF INVENTION

It has now been discovered that the low cycle and thermal fatigue life of alloys described herein can be markedly improved provided the carbon, nitrogen and silicon contents are controlled and correlated such that the sum of the % carbon + % nitrogen + 1/10% silicon does not exceed about 0.04% and is preferably not greater than about 0.035%. Moreover, low cycle and thermal fatigue is further enhanced if the alloys are processed by vacuum induction melting followed by electroslag refining.

EMBODIMENTS OF THE INVENTION

In accordance with the present invention, the preferred alloy contemplated herein contains about 6 to 12% molybdenum, 19 to 27% chromium, 3 to 5% niobium, up to 8% tungsten, up to 0.6% aluminum, up to 0.6% titanium, carbon from 0.001 to about 0.03%, nitrogen from 0.001 to about 0.035%, silicon from 0.001 to 0.3%, with the carbon, nitrogen and silicon being correlated such that the % carbon + % nitrogen + 1/10% silicon is less than about 0.035% whereby low cycle and thermal fatigue properties are enhanced, up to 5% iron and the balance essentially nickel. The strength of the alloy is obtained principally through matrix stiffening and, thus, precipitation hardening treatments are not required. However, columbium will form a precipitate of the $Ni_3Nb$ type (gamma double prime) upon aging if higher stress-rupture strength would be required for a given application. In this connection the percentage of aluminum and titanium can also be increased to a total of, say, 5%. Conventional aging treatments can be employed, e.g., 1350° to 1550° F. (732° to 843° C.).

In addition to the above, it has been found that vacuum induction melting (VIM) contributes to improved fatigue properties particularly when followed by refining through electroslag remelting (ESR). This processing sequence lends to a cleaner microstructure which when combined with the aforedescribed carbon/nitrogen/silicon control provides for optimum fatigue behavior. Ductility is also improved through this processing route.

In carrying the invention into practice care must be exercised to ensure a proper correlation among carbon, nitrogen and silicon. These constituents combine with the reactive elements of the alloy to form insoluble precipitates, such as carbides, carbonitrides, silicides, etc., which it is believed, hasten the initiation of low cycle and thermal fatigue. Accordingly, it is most preferred that the sum of % carbon + % nitrogen + 1/10% silicon not exceed 0.03%.

In terms of other constituents the chromium can be from 20 to 24%, the higher the chromium the greater is the ability of the alloy to resist corrosive and oxidative attack. Molybdenum and niobium serve to confer strength, including stress-rupture strength at elevated temperature, through matrix stiffening and also impart corrosion resistance together with chromium. However, where it is necessary to minimize the formation of detrimental volumes of deleterious phases such as sigma the chromium plus molybdenum should not exceed about 35%. The molybdenum and niobium can be extended downwardly to 5% and 2%, respectively.

Speaking more generally, alloys containing 30 to 75% nickel, up to 50% iron, 12 to 30% chromium, up to 10% molybdenum, up to 8% tungsten, up to 15% cobalt, up to 5% niobium plus tantalum with minor amounts of aluminum, titanium, copper, manganese will provide adequate resistance to high temperature gaseous corrosion as might be expected in recuperator operating environments. Of course, the carbon/nitrogen-/and silicon must be controlled as above described. However, even as to this embodiment it is preferable that the nickel content be from 50% to 70%, the iron 1.5 to 20% and the chromium from 15 to 25%, particularly with at least one of molybdenum and niobium from 5 to 12% and 2 to 5%, respectively.

The foregoing alloy compositions will possess, in addition to excellent fatigue properties, corrosion resistance, high strength and thermal conductivity and low coefficient of expansion which lend to minimizing thermal stresses due to temperature gradients.

To give those skilled in the art a better understanding of the invention the following information and data are given:

EXAMPLE I

An alloy (Alloy A) having the following chemical composition was vacuum induction melted into an ingot which was then electro refined in an electroslag remelting furnace (ESR): 8.5% Mo, 21.9% Cr, 3.4% Cb, 4.5% Fe, 0.2% Al, 0.2% Ti, 0.05% Mn, 0.014% C, 0.006% N, 0.06% Si, the balance nickel and impurities. It will be noted that the sum of % carbon plus % nitrogen plus 1/10% silicon is 0.026.

The ESR ingot was initially hot rolled to a four inch thick slab which was then coil rolled hot to a thickness of 0.3 inch and then cold rolled to 0.014 inch (0.36 mm) thick sheet. Intermediate anneals were utilized during cold rolling. The 0.014 inch material was then annealed at 1900° F. (1038° C.) for a period of about 26 seconds, cold rolled approximately 43% to a thickness of 0.006 inch (0.2 mm) and then given a final anneal at 1950° F. (1066° C.) for about 30 seconds. The resulting sheet product was tensile tested in both the longitudinal and transverse directions and for cycle fatigue failure as well as microstructural stability, the results being reported in Tables I, II and III. In determing fatigue life an MTS (Model 880) low cycle fatigue machine was used. It is a tension-tension device which operates at 5,000 cycles per hour with the minimum tension being 10% of the maximum set stress.

TABLE I

| | 0.2% Y.S. | | U.T.S. | | Elongation |
|---|---|---|---|---|---|
| | KSI | MPa | KSI | MPa | % |
| Longitudinal | 73.5 | 507 | 137.8 | 948.3 | 44.5 |
| Transverse | 76.4 | 527 | 135.1 | 931.0 | 50.0 |

Y.S. = Yield Strength
U.T.S. = Ultimate Tensile Strength

TABLE II

| Applied Stress | | |
|---|---|---|
| KSI | MPa | Cycles To Failure* |
| 100 | 690 | 171,000** |

TABLE II-continued

| Applied Stress | | |
|---|---|---|
| KSI | MPa | Cycles To Failure* |
| 110 | 758 | 1,672,500** |
| 120 | 827 | 8,300 |

*Fatigue properties determined at 1000° F. (538° C.)
test stopped at 171,000 cycles without a failure *test stopped without failure The grain size of annealed Alloy A was ASTM 9. It is deemed that the annealed condition affords an optimal material for use in bellows and recuperators.

TABLE III

| | 0.2% Y.S. | | U.T.S. | | Elongation |
|---|---|---|---|---|---|
| Alloy Condition | KSI | MPa | KSI | MPa | % |
| as-annealed | 76.4 | 527 | 135.1 | 931 | 50.0 |
| as-annealed plus 310 hrs at 1000° F. (538° C.) | 76.0 | 524 | 133.5 | 920 | 46.0 |

The tensile data and stability data compare favorably with published corresponding properties for the alloy of '500. What is of importance is the low cycle fatigue data. Using the applied stress of 100,000 psi as a standard it will be observed that Alloy A went 171,000 cycles without failure. This becomes more striking given a comparison with EXAMPLE II below.

EXAMPLE II

An alloy (Alloy B) containing 8.5% Mo, 21.6% Cr, 3.6% Cb, 3.9% Fe, 0.2% Al, 0.2% Ti, 0.2% Mn, 0.03% C, 0.029% N, 0.29% Si, balance nickel and impurities was prepared using air melted, argon oxygen decarburization refining followed by electroslag remelting. The material, which corresponds to the alloy described in '500, was similarly processed as in Example I except the final anneal was conducted at 2050° F. for 15 to 30 seconds, the resulting data being given in Tables IV, V and VI.

TABLE IV

| | 0.2% Y.S. | | U.T.S. | | Elongation |
|---|---|---|---|---|---|
| | KSI | MPa | KSI | MPa | % |
| Longitudinal | 51.9 | 358 | 124.0 | 855 | 54.0 |
| Transverse | 50.7 | 350 | 118.2 | 815 | 57.0 |

TABLE V

| Applied Stress | | |
|---|---|---|
| KSI | MPa | Cycles To Failure |
| 90 | 621 | 8,900 |
| 100 | 690 | 700 |
| 110 | 758 | 90 |

TABLE VI

| | 0.2% Y.S. | | U.T.S. | | Elongation |
|---|---|---|---|---|---|
| Alloy Condition | KSI | MPa | KSI | MPa | % |
| as-annealed | 50.7 | 350 | 118.2 | 815 | 57.0 |
| as-annealed plus 300 hrs. at 1000° F. (538° C.) | 60.7 | 419 | 113 | 781 | 31.5 |

The striking difference between Examples I and II is low cycle fatigue properties. The % carbon+% nitrogen+1/10% silicon value for Alloy B was 0.088. It might be added that air melting per se introduces nitrogen into a melt even in laboratory size heats and particularly in commercial size heats. Using the 100,000 psi applied stress as a standard it can be seen that LCF for Alloy A was well over 200 times greater than for Alloy B. This marked difference/improvement offers longer lived bellows and recuperators.

EXAMPLE III

To further demonstrate the importance of controlling the levels of carbon, nitrogen and silicon such that % carbon+% nitrogen+1/10% silicon is less than 0.04% reference is made to Alloy C, an alloy encompassed by '500 and containing 8.2% Mo, 22.5% Cr, 3.3% Cb, 3.7% Fe, 0.3% Al, 0.2% Ti, 0.09% Mn, 0.028% C, 0.01% N, 0.14% Si, balance nickel and impurities. This composition was prepared using vacuum induction melting followed by electroslag remelting and then processed as in Example I except that the material was coiled. Tensile properties are given in Table VII with values being set forth for both the "start" and "Finish" locations in the coil.

TABLE VII

| Location in Coil | 0.2% Y.S. KSI | 0.2% Y.S. MPa | U.T.S. KSI | U.T.S. MPa | Elongation % |
|---|---|---|---|---|---|
| | Longitudinal Direction | | | | |
| Start | 73.8 | 509 | 139.8 | 964 | 47.0 |
| Finish | 73.1 | 504 | 138.2 | 953 | 47.0 |
| | Transverse Direction | | | | |
| Start | 74.9 | 516 | 137.1 | 945 | 48.0 |
| Finish | 73.7 | 508 | 135.0 | 931 | 49.5 |

TABLE VIII

| Applied Stress KSI | Applied Stress MPa | Cycles To Failure |
|---|---|---|
| 100 | 690 | 10,400 |
| 110 | 758 | 6,900 |
| 120 | 877 | 800 |

It is clear that Alloy A of controlled carbon, nitrogen and silicon was quite superior to Alloy C having a % carbon+% nitrogen+1/10% silicon value of 0.052 (versus 0.026 for Alloy A) in terms of low cycle fatigue. The VIM+ESR processed Alloy C offered, however, an improvement over Air Melted+AOD+ESR processed Alloy B.

The foregoing discussion has centered on bellows and recuperators. However, it is considered that the invention is applicable to other applications requiring nickel-chromium containing alloys of improved fatigue properties, such as high temperature springs, valves, thrust reverser assemblies, fuel nozzles, after burner components, spray bars, high temperature ducting systems, etc.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A nickel-chromium alloy characterized by (i) enhanced fatigue properties as well as (ii) tensile properties and (iii) structural stability, said alloy consisting essentially of 6 to 12% molybdenum, 19 to 27% chromium, 2 to 5% niobium, up to 8% tungsten, up to 0.6% aluminum, up to 0.6% titanium, carbon present in an amount up to 0.03%, nitrogen present up to 0.03%, silicon up to 0.35%, the carbon, nitrogen and silicon being correlated such that the sum of % carbon+% nitrogen+1/10% silicon is less than about 0.035%, up to 5% iron and the balance nickel.

2. The alloy of claim 1 in sheet form.

3. The alloy of claim 1 having been produced using vacuum induction melting.

4. The alloy of claim 3 having been produced using electroslag remelting.

5. The alloy of claim 1 containing 2.5% to 5% niobium and in which the % carbon+% nitrogen+1/10% silicon does not exceed about 0.03%.

6. As a new article of manufacture, a bellows made from the alloy of claim 1.

7. As a new article of manufacture, a recuperator made from the alloy of claim 1.

8. A nickel-chromium alloy characterized by enhanced fatigue properties together with good tensile properties and structural stability, said alloy consisting essentially of from 30 to 75% nickel, 12 to 30% chromium, up to 10% molybdenum, up to 8% tungsten, up to 15% cobalt, up to 5% of niobium and/or tantalum, titanium plug aluminum up to 5%, and carbon, nitrogen present and silicon in correlated percentages such that the % carbon+% nitrogen+1/10% silicon is less than about 0.04 to thereby improve low cycle and thermal fatigue strength the balance being from 0 to 50% iron.

9. The alloy set forth in claim 8 containing 50 to 70% nickel, 15 to 25% chromium, 1.5 to 20% iron, at least one of molybdenum and niobium in amounts of 5 to 12% and 2 to 5%, respectively, titanium and aluminum each up to about 0.6%, the % carbon+% nitrogen+1/10% silicon being not greater than 0.035.

10. As a new article of manufacture, a bellows formed from the alloy of claim 8.

11. As a new article of manufacture, a recuperator made from the alloy of claim 8.

12. The alloy set forth in claim 8 containing 50 to 70% nickel, 15 to 25% chromium, 1.5 to 20% iron, at least one of molybdenum and niobium in amounts of 5 to 12% and 2 to 5%, respectively, and with both of titanium and aluminum being present in a total amount up to about 5%.

13. As a new article manufacture, a recuperator or bellows made from an alloy consisting essentially of 6 to 12% molybdenum, 19 to 27% chromium, 2 to 5% niobium, up to 8% tungsten, up to 0.6% aluminum, up to 0.6% titanium, carbon present in an amount up to 0.03%, nitrogen up to 0.03% silicon up to 0.35%, the carbon, nitrogen and silicon being correlated such that the sum of % carbon+% nitrogen+1/10% silicon is less than about 0.035%, up to 5% iron and the balance nickel, the alloy being characterized by enhanced fatigue properties as well as strength properties and structural stability.

14. As a new article manufacture a recuperator or bellows made from an alloy consisting essentially of from 30 to 75% nickel, 12 to 30% chromium, up to 10% molybdenum, up to 8% tungsten, up to 15% cobalt, up to 5% of niobium and/or tantalum, titanium plus aluminum up to 5%, and carbon, nitrogen and silicon in correlated percentages such that the % carbon+% nitrogen+1/10% silicon is less than about 0.04 to thereby improve low cycle and thermal fatigue strength the balance being up to 50% iron.

* * * * *